United States Patent [19]

Maring et al.

[11] 4,270,363

[45] Jun. 2, 1981

[54] REFRIGERATING MACHINE INCLUDING ENERGY CONSERVING HEAT EXCHANGE APPARATUS

[75] Inventors: Oscar M. Maring, Clear Lake; Kenneth W. Schneider, Mason City, both of Iowa

[73] Assignee: Schneider Metal Manufacturing Company, Mason City, Iowa

[21] Appl. No.: 30,700

[22] Filed: Apr. 16, 1979

[51] Int. Cl.[3] ..... F25D 17/06

[52] U.S. Cl. ..... 62/179; 62/184; 62/196 B

[58] Field of Search ..... 62/184, 179, 196 B, 62/238 E

[56] References Cited

U.S. PATENT DOCUMENTS

| | | | |
|---|---|---|---|
| 2,142,734 | 1/1939 | Polley | 62/184 |
| 2,572,582 | 10/1951 | Andrews | 62/184 |
| 2,751,761 | 6/1956 | Borgerd | 62/238 E |
| 3,301,002 | 1/1967 | McGrath | 62/238 E X |
| 3,922,876 | 12/1975 | Wetherington, Jr. et al. | 62/238 E X |
| 3,926,008 | 12/1975 | Webber | 62/200 |
| 4,041,726 | 8/1977 | Mueller et al. | 62/238 E |
| 4,134,274 | 1/1979 | Johnsen | 62/179 |

*Primary Examiner*—William E. Tapolcai, Jr.

*Attorney, Agent, or Firm*—Kegan, Kegan & Berkman

[57] ABSTRACT

An improved commercial cube/crushed ice making machine includes a refrigeration unit having a water-to-refrigerant heat exchange condenser operatively connectible to an external water supply for heating water therein. The condenser provides for improved efficiency in the refrigeration unit over a conventional air-cooled condenser. Also, the water heating capability of the ice-making machine preferably functions as a secondary heat source for the external water supply, thus providing savings in energy costs for the primary water heating source. Further, the heat exchange relation between the refrigeration unit and the external water supply is determined by an improved control system which is responsive to both a refrigerant pressure at the condenser refrigerant outlet, and the water temperature at the condenser water outlet for controlling water flow through the condenser while maintaining a pre-determined refrigerant pressure in the heat exchange means.

7 Claims, 4 Drawing Figures

FIG. 2
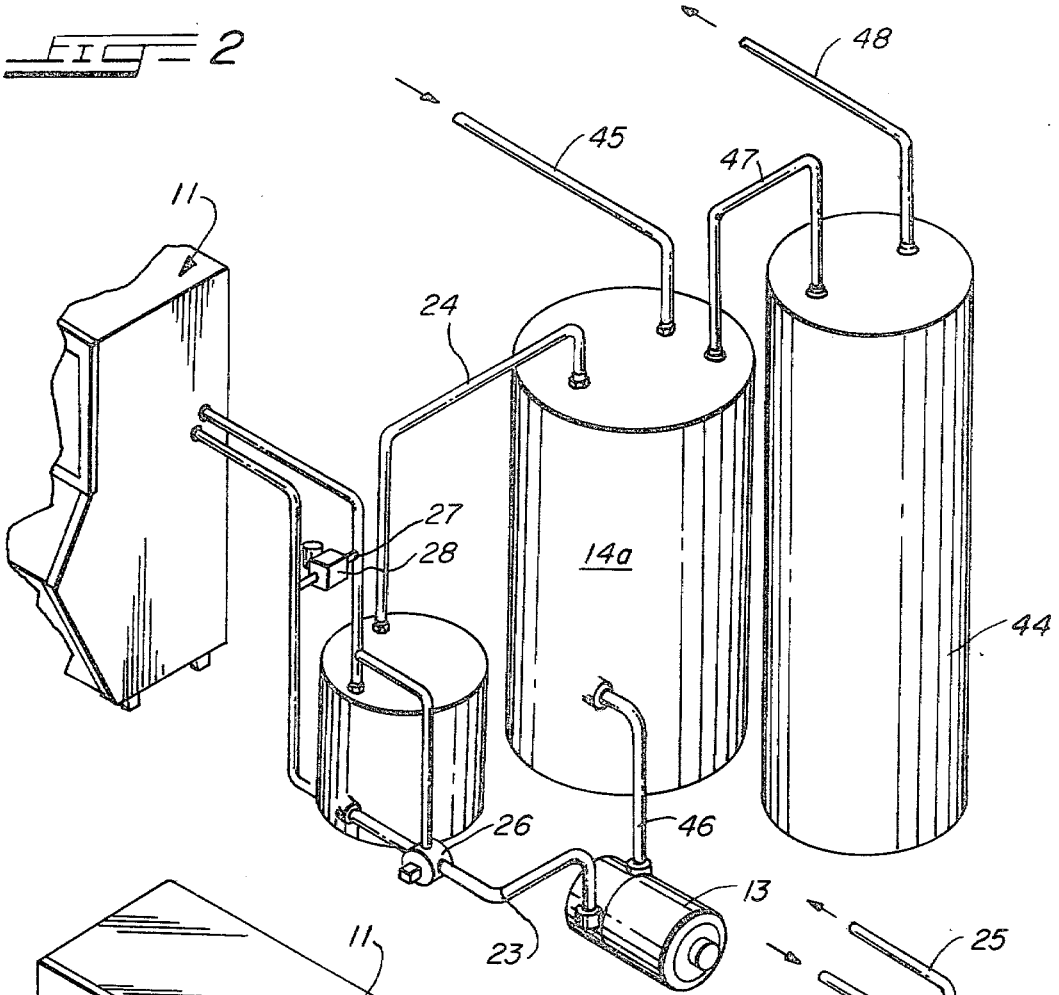
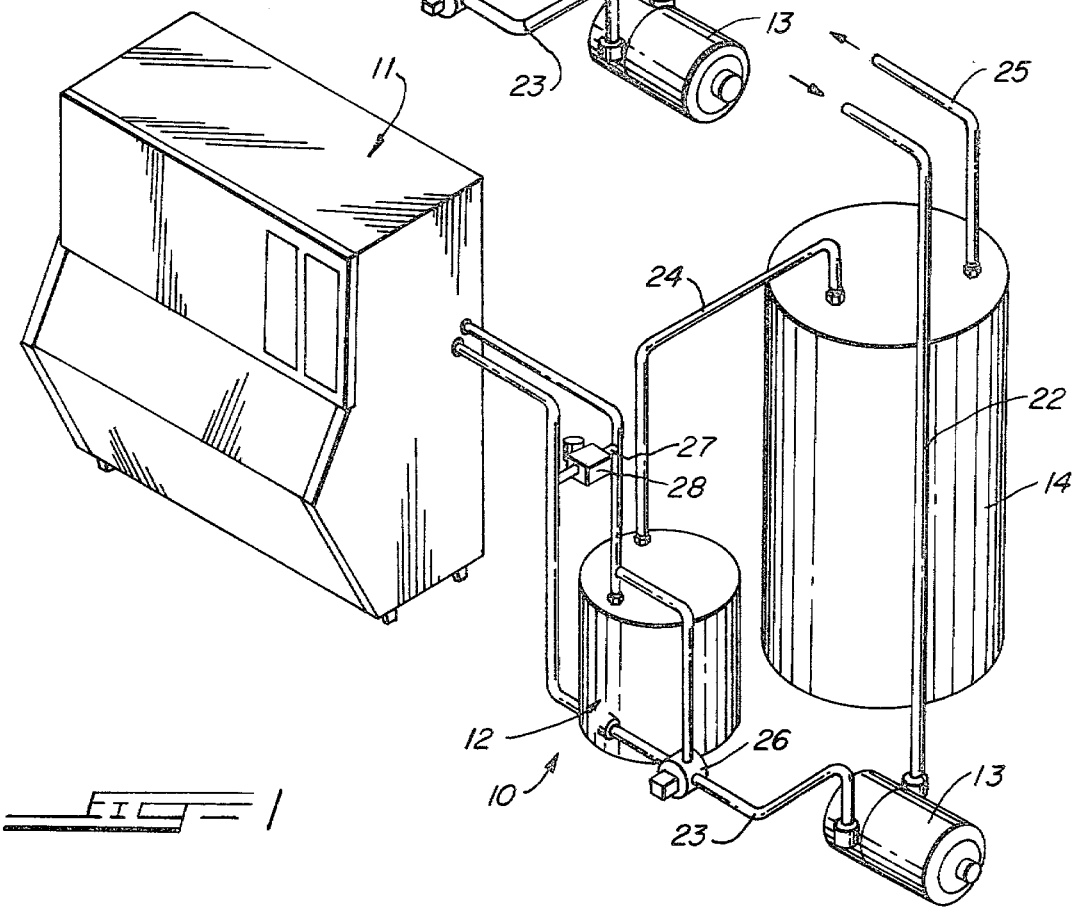
FIG. 1

REFRIGERATING MACHINE INCLUDING ENERGY CONSERVING HEAT EXCHANGE APPARATUS

BACKGROUND OF THE INVENTION

The present invention relates generally to ice-making machines, and more particularly to a commercial cube/-crushed ice-making machine which is capable of efficiently transferring heat rejected during the ice-making process to heat water in a conventional external water supply having a conduit thereof positioned adjacent the machine.

It has long been known that there is substantial heat rejection from a condenser in a conventional refrigeration unit consisting serially of a compressor, condenser, expansion valve and evaporator. Various devices and systems have been employed in attempts to utilize the rejected heat for purposes of heating fluids such as water and air. Embodiments of specific refrigeration systems and specific heat applications therefor are disclosed in the following U.S. Pat. Nos.: 3,926,008; 4,041,726; 3,922,876; 3,358,469; 3,513,663; and 2,739,452. Further, most heretofore known commercial ice-making machines with a capacity approximating 300–1000 lbs. of ice per day have utilized air-cooled condensers, rather than more efficient water-cooled condensers, because an air-cooled condenser is cheaper and less bulky.

Recent worldwide increases in fuel and energy costs have created a need for expanding the use of heat conservation and heat reclamation systems, with specialized refrigeration systems not heretofore considered for such use.

Additionally, the prior known energy conservation systems which have been combined with refrigeration units have heretofore included controls which were responsive to changes in the temperatures of the refrigerant being cooled and the fluid being heated. While the temperature of the fluid being heated is an important parameter for control purposes, the temperature of the refrigerant in the condenser is important, but only secondarily to the efficiency of the refrigeration system. A prime factor in refrigeration efficiency is an optimum (not a maximum) pressure drop across the thermal expansion valve. None of the energy conservation systems heretofore known have disclosed a control system which optimizes the efficiency of the refrigeration unit while providing a controlled transfer of heat energy from the refrigeration condenser to an external air or water supply.

Further, it has been noted that a substantial number of commercial ice-making machines are permanently installed for use in buildings such as motels, hotels, restaurants, etc. in close proximity to external water supplies in those buildings. Applicant has realized that in certain installations a refrigerant to water condensor may be used in a commercial ice-making machine and combined with or tapped into an adjacent external water supply to provide added efficiency to the ice-making machine and, at the same time, save energy by acting as a secondary heat source for the external water supply.

Therefore, it is an object of the present invention, generally stated, to provide an refrigerating machine having improved cooling efficiency.

Another object of the present invention is to provide a new and improved refrigerating machine including heat reclamation means for heating an external water supply.

A further object of the present invention is the provision of an refrigerating machine including heat reclamation means in connection with a condenser therein and a control system for same which is responsive to a refrigerant pressure in the condenser for providing added efficiency to the refrigeration system.

SUMMARY OF THE INVENTION

This invention relates to an refrigerating machine including heat reclamation means for heating an external water system. The machine has a closed loop refrigeration system serially including therein: a compressor, a refrigerant-to-water condenser whereby heat rejected from the closed loop system is transferred to the heat reclamation means through the condenser, an expansion valve, and an evaporator. The machine includes a control system having means responsive to both a refrigerant pressure in the condenser and a water temperature in the condenser for controlling heat exchanging water flow through the condenser while maintaining a predetermined refrigerant pressure therein.

BRIEF DESCRIPTION OF THE DRAWINGS

The features of the present invention, which are believed to be novel, are set forth with particularity in the appended claims. This invention may best be understood by reference to the following description of presently preferred embodiments thereof taken in conjunction with the accompanying sheets of drawings in the several figures of which like reference numerals identify like elements, and in which:

FIG. 1 is a perspective view of an ice-making machine including a heat reclamation device constructed in accordance with the present invention which is operatively connected to an external water supply.

FIG. 2 is a perspective view of a modification of the heat reclamation device shown in FIG. 1 including the addition of a hot water heater thereto.

DETAILED DESCRIPTION OF THE PREFERRED EMBODIMENT

Figures 3, 4:
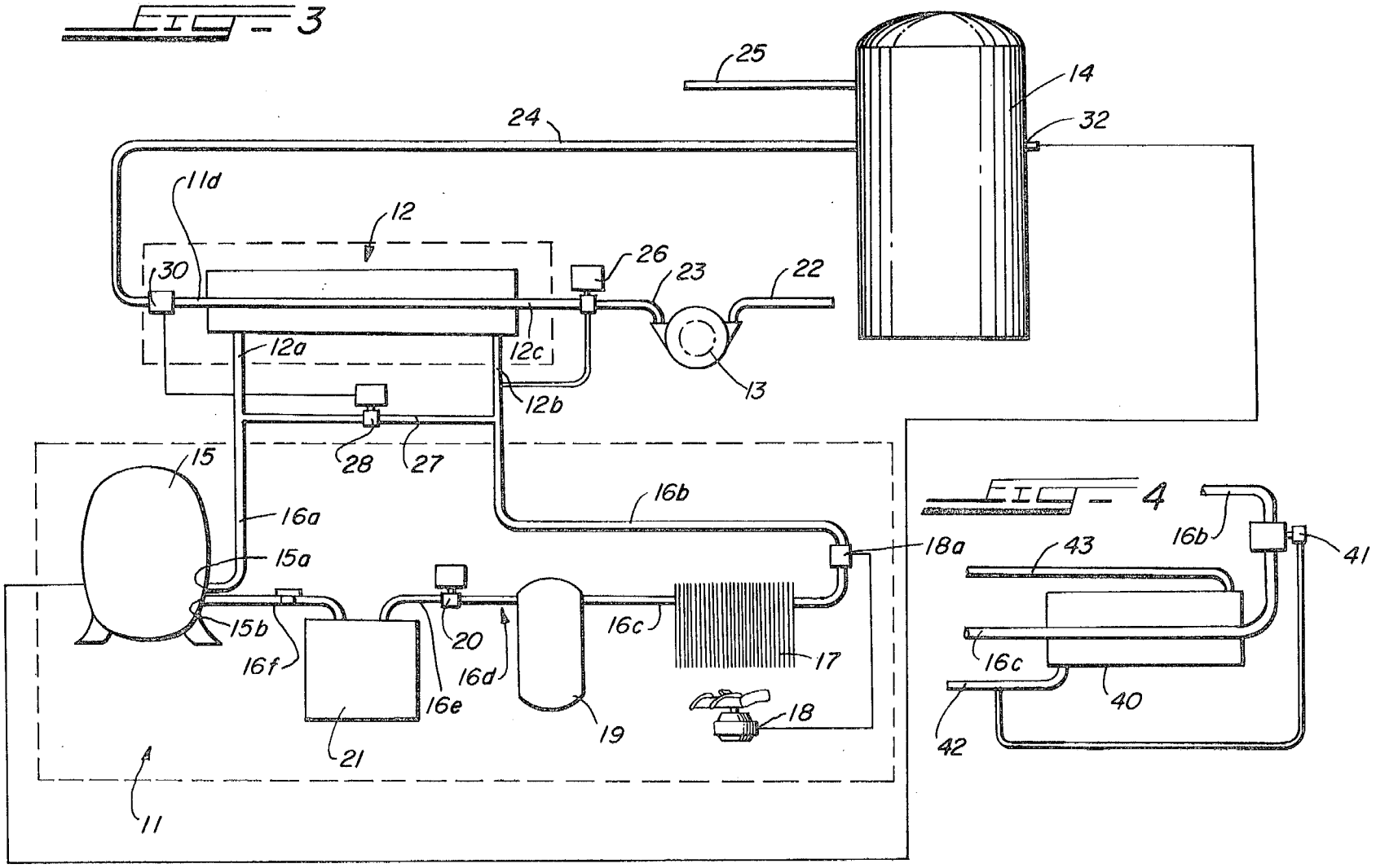
FIG. 3 is a schematic diagram of a refrigeration system, heat reclamation means, and a portion of an external water supply shown connected for operation in accordance with the present invention.
FIG. 4 is a fragmentary diagrammatic view of a water-cooled secondary condenser which may be substituted for the air-cooled secondary condenser shown in FIG. 3.

Referring to FIGS. 1 and 3, an ice-maker and heat reclamation system constructed in accordance with the present invention, and generally indicated at 10, includes a commercial ice-maker 11 such as sold under the trademark ROSS-TEMP, and a conventional refrigerant-to-water condenser 12 which, in this embodiment, is positioned externally of the ice-maker. The heat reclaiming device or condenser 12 is preferably connected to a conventional external water supply which, in this embodiment, is shown to include a water pump 13 and a hot water storage tank 14 connected in series with the coolant side of the condenser 12.

While any commercial ice-maker may be utilized in the system of the present invention, two commercial ice-making systems (neither shown) are ideally suited for use with the heat reclamation system of the present invention. In the first type, a layer of ice is formed on the bottom of a working sheet or plate. When the layer of ice has achieved a sufficient thickness, it is separated from the plate and dropped onto a heated grid or matrix. As the sheet of ice passes through the matrix, it is divided into ice cubes thereby. The second type of commercial ice-maker utilizes a hollow cylinder with ice being formed on an exterior surface thereof. An auger or the like is sleeved over the evaporator and includes a helical working edge which sweeps across the hollow cylindrical surface to shave ice therefrom in order to create "crushed" ice.

As shown most clearly in FIG. 3, the refrigeration system of the ice-maker 11 includes a conventional refrigerant compressor 15 having a high pressure exhaust port 15*a* which is connected by conduit 16*a* to refrigerant inlet port 12*a* of the heat reclamation condenser 12. The refrigerant outlet port 12*b* is connected by conduit 16*b* to a secondary air-cooled condenser 17 having a cooling fan 18 and a fan control switch 18*a* associated therewith. A refrigerant receiver or accumulator 19 is operatively positioned between the secondary condenser and a thermal expansion valve 20 by conduits 16*c* and 16*d*. A conventional evaporator 21 and conduit 16*e* are downstream of the valve and operatively connected via conduit 16*f* to a low pressure inlet port 15*b* of the compressor. It can be appreciated that for ease of adaptability, the air-cooled secondary condenser 17 may be the original equipment condenser for the separate ice-maker. If the refrigerant-to-water condenser 12 is mounted within the physical confines of the ice-maker 11, it is understood that it could be sized to completely replace the secondary air-cooled condenser 16. The purpose of the secondary condenser will be discussed in connection with the operation of the system. In the embodiment shown in FIGS. 1 and 3, the water supply includes a pump 13 which receives water from an inlet conduit 22 and pumps same through outlet conduit 23 to the water inlet port 12*c* of the refrigerant-to-water condenser 12 where the water is positioned in heat exchange relation with the high pressure refrigerant and passes out water outlet port 12*d*, through temperature actuated sensor 30, and conduit 24 to the hot water storage tank 14 where the water may be discharged through conduit 25.

Depending upon the circumstances surrounding an individual installation, i.e., the size and amount of use of the ice-maker, and the size and use of the external water supply, the condenser 12 may act as a primary or secondary heating source for the water supply. However, since the control system, to be discussed in detail below, does not provide for operation of the compressor if the ice machine is filled to capacity, it is assumed that in most installations the condenser 12 will act as only a secondary heat source for the water supply.

In accordance with one aspect of the invention, the flow of water from pump 13 into the refrigerant-to-water condenser 12 is regulated by a valve 26 which acts in response to the pressure of the refrigerant at outlet 12*b* of the condenser. The operational pressure of the refrigerant proximately ranges from about 100 psig to about 160 psig as discussed in more detail hereafter. Additionally, a condenser bypass conduit 27 which bridges between the refrigerant inlet and outlet ports 12*a*, 12*b*, respectively, of the condenser 12 includes a solenoid operated valve 28 therein which is actuated by a temperature sensor 30 positioned adjacent the water discharge port 12*d* of condenser 12. Valve 28 is a fail-safe valve which, in this embodiment, shuts off the heat exchanging condenser if water usage is so minimal that the water temperature reaches a severely high level.

In operation, when the ice machine compressor 15 is initially turned on, the pressure regulation valve 26 controls the flow of water through the condenser 12 to maintain a preset pressure, in this embodiment approximately 100–120 psig at the outlet port 12*b* of condenser 12. If the initial temperature of the water is about 60° F., water flow through the condenser will be minimized such that the water exit temperature therefrom approximates 100° F. The refrigerant temperature at outlet port 12*b* may then approximate 80° F.

Depending upon the size of the external water system, as the inlet water temperature rises, valve 26 gradually opens to allow greater water flow through the condenser 12 in order to maintain the pre-determined refrigerant pressure at the condenser outlet 12*b*. In the embodiment shown, the water flow through the condenser will be at its maximum when the inlet water temperature is approximately 100° F. or above. As long as the temperature in the water supply is approximately 100° F. or less, the refrigerant may be maintained at approximately 120° F. and 120 psig, and all of the heat rejected from the ice machine is absorbed into the water system. This heat includes the sensible heat from superheating the refrigerant vapor, the latent heat from condensing the refrigerant, and the sensible heat from subcooling the refrigerant liquid. Also since a water-cooled condenser has been utilized, the refrigerant discharge pressure has been lower than the usual discharge pressure achieved when solely using an air-cooled condenser. With the high pressure refrigerant being an optimal value, which is lower than achievable with an air-cooled condenser, the machine has been operating more efficiently than heretofore-known ice machines of comparable size.

In the embodiment shown, as the water in the external water supply rises in temperature above 100° F. to approximately 110° F., the temperature or pressure of the refrigerant will be sufficiently high (approximating 120° F. and 160 psig) to actuate the switch 18*a* and turn on the motor 18 of the air-cooled secondary condenser 17. Until such time as the inlet water temperature of water supply reaches approximately 125° F., the switch 18*a* cycles the fan on and off at approximately two-minute intervals. The additional condenser capacity in this embodiment acts to lower the refrigerant pressure to a satisfactory level approximating 120 psig, but nevertheless, to a level which is higher than the discharged pressure when the refrigerant-to-water condenser 12 was the sole heat rejection means in the system. However, since the refrigerant-to-water condenser is still in the system, the refrigerant high side pressure is still lower and closer to optimum than if an air-cooled condenser alone were present in the system; thus, the system is still more efficient than a system solely using an air-cooled condenser. When the external water system temperature reaches approximately 125° F., the dual condensers can no longer lower the refrigerant pressure to 120 psig and the air-cooled condenser motor 18 begins to run constantly rather than cyclicly. With the air-cooled condenser fan on constantly, the heat transferred to the water in the condenser 12 through desuperheating will be added at a lower rate than previously described.

When the condenser outlet water temperature in this embodiment reaches a preset maximum, approximating 180° F., the sensor 30 actuates the solenoid 28 to open the bypass line 27 allowing most of the hot refrigerant vapor to pass directly to the air-cooled condenser 16. Thus, heating in the external water system is stopped although the ice machine may continue to function. An additional safety sensor 32 at the hot water storage tank 14 is capable of stopping the operation of the compressor 15 if the water temperature in the tank reaches an unsafe temperature, approximating 200° F. It should be noted that during normal operation both hot water usage and actual ice usage will, to some extent, determine the operation of the heat reclaiming device. During normal operating hours, when both the ice machine and hot water system would be in use, the condenser 12 would be of sufficient size to handle all heat rejected by the ice machine. If the use of the external water supply should drop substantially or stop, in connection with an embodiment having a secondary air-cooled condenser, it may be expected that the secondary condenser would run in its cyclic phase during such extreme circumstances.

Referring to FIG. 2, in a second embodiment of the present invention, the hot water storage tank 14, in accordance with another aspect of the invention, serves as a pre-heater which is positioned in the hot water system in parallel with a conventional hot water heater 44 such that the water supply inlet conduit 45 directs water into the storage tank where that water is mixed with heated water already in the tank. There are two discharge conduits from the hot water storage tank 14*a*, a first conduit 46 feeding the water pump 13, and a second conduit 47 feeding the water heater 44 which has a conventional discharge conduit 48. Operation of this system is similar to the operation described above in connection with the first embodiment.

Referring to FIG. 4, a modification of the system shown in connection with FIG. 3 may include a second independent water-to-water condenser 40 or a second stage of condenser 12 may be positioned in the refrigeration unit to replace the air-cooled condenser 16. The water-cooled secondary condenser 40 would operate in a manner similar to air-cooled condenser 16 in that the pressure regulating valve 41 would not turn on a separate water cooling system, indicated by inlet conduit 42 and outlet conduit 43, until the primary refrigerant-to-water condenser 12 was operating at full heat reclaiming capacity.

Thus, the commercial ice-maker and heat reclamation device combination of the present invention provides an efficient means of reclaiming the heat rejected from the refrigeration cycle of a commercial ice-making machine and transferring same to an external hot water supply. Not only does the system of the present invention provide an additional refrigeration device from which heat may be reclaimed, but the use of a refrigerant-to-water condenser in a commercial ice-maker coupled with a control system which is responsive to refrigerant condenser outlet pressure rather than temperature provides added efficiency to the commercial ice-making device while, at the same time, reclaiming the heat rejected from the refrigerant cycle.

While three particular embodiments and variations of the invention have been shown and described, it will be obvious to those skilled in the art that changes and modifications may be made without departing from the invention in its broader aspects. Therefore, the aim in the appended claims is to cover all such changes and modifications as may fall within the true spirit and scope of the invention.

We claim:

1. In a refrigerating machine including heat reclamation means for heating an external water system, said machine comprising:

a closed loop refrigeration system serially including a compressor, heat exchange means including a refrigerant-to-water first condenser and an auxiliary condenser, whereby heat rejected from said closed loop system is transferred to said heat reclamation means through said first condenser, refrigerant expansion means, an evaporator; and a control system including means being responsive both to a refrigerant pressure at a first outlet of said first condenser and to a water temperature at a second outlet of said first condenser for controlling water flow through said first condenser while maintaining a pre-determined refrigerant pressure in said heat exchange means; and means responding to a first pre-determined refrigerant pressure at said first outlet for actuating said auxiliary condenser, said pre-determined refrigerant pressure includes a range of pressures extending from a substantially optimum lower pressure to a maximum acceptable pressure, and said first predetermined refrigerant pressure being therebetween.

2. A refrigerating machine including a water heating system comprising:

a refrigerant compressor including a low pressure inlet port and a high pressure outlet port;

a refrigerant-to-water condenser in operative communication with said compressor outlet port;

refrigerant expansion means operatively positioned downstream of said condenser;

an evaporator having an inlet port in operative communication with said refrigerant expansion means downstream thereof, and an outlet port in operative communication with said inlet port of said refrigerant compressor;

means for moving water through said condenser in cross-flow heat exchange relation with refrigerant passing therethrough;

means for accumulating heated water downstream of said condenser;

a combination refrigerant and water control system including a refrigerant pressure sensor positioned to sense condenser outlet refrigerant pressure, a water temperature sensor positioned to sense condenser outlet water temperature, and means responsive to said pressure and temperature sensors for controlling water flow through said condenser while maintaining a pre-determined refrigerant pressure therein;

an auxiliary refrigerant condenser operatively positioned between said refrigerant-to-water condenser and said expansion means; and said control system including means for activating said auxiliary condenser when said refrigerant pressure reaches detects a first predetermined value.

3. In a combined refrigerating and water-heating machine including an automated control system for same comprising:

a closed circuit refrigerant system serially including:

a refrigerant compressor including a low pressure inlet port and a high pressure outlet port;

a first portion of a refrigerant to water condenser downstream of said compressor outlet port;

refrigerant expansion means downstream of said condenser;

an evaporator downstream of said expansion means and upstream of said compressor inlet port; and a water heating system including:

a second portion of said refrigerant-to-water condenser being in heat exchange relation with said refrigeration system;

a water pump upstream of said second portion of said condenser;

hot water storage means positioned downstream of said second portion of said condenser; and an automated control system including:

a pressure sensor adapted to determine a pressure at a refrigerant outlet of said condenser; and a water flow regulating valve in said water heating apparatus downstream of said pump and upstream of said second condenser portion, said water flow valve responding to said pressure sensor for controlling water moving through said condenser while maintaining a pre-determined refrigerant pressure range in said refrigerant system.

4. The refrigerating and water-heating machine as defined in claim 3 wherein said water-heating system defines a closed loop with said hot water storage means positioned upstream of said water pump, and defining a water-to-water heat exchanger.

5. The refrigerating and water-heating machine as defined in claim 3 wherein said control system further includes means for by-passing said refrigerant-to-water condenser if said water temperature reaches an upper limit temperature.

6. The refrigerating and water-heating machine as defined in claim 3 wherein said control system further includes:

a temperature sensor adapted to determine a temperature at a water outlet of said condenser; and a refrigerant flow regulating valve positioned in by-pass relation with said first portion of said refrigerant-to-water condenser, said refrigerant flow valve responding to said water temperature sensor to prevent overheating of said refrigerant-to-water condenser.

7. A sub-combination of elements adapted for operative connection with a refrigerating machine having a closed loop refrigeration system therein serially including a compressor, heat exchange means including an original equipment condenser, refrigerant expansion means, and an evaporator; said sub-combination of elements reclaiming heat from said system and comprising:

a refrigerant-to-water first condenser including a first outlet for flow of refrigerant therethrough, and a second outlet for flow of water therethrough;

a control system including means being responsive both to a refrigerant pressure at said first outlet and to a water temperature at said second outlet for controlling water flow through said first condenser while maintaining a predetermined refrigerant pressure range in said heat exchange means; and means responding to a first pre-determined refrigerant pressure at said first outlet for actuating said original equipment condenser, said pre-determined refrigerant pressure range includes pressures extending from a substantially optimum lower pressure to a maximum acceptable pressure, and said first pre-determined refrigerant pressure being therebetween.

* * * * *

UNITED STATES PATENT AND TRADEMARK OFFICE

CERTIFICATE OF CORRECTION

PATENT NO. : 4,270,363

DATED : June 2, 1981

INVENTOR(S) : Oscar M. Maring et al.

It is certified that error appears in the above—identified patent and that said Letters Patent is hereby corrected as shown below:

Column 6, Claim 2, line 60, after "reaches" delete the word -- detects --.

Signed and Sealed this

*Eighteenth* Day of *August 1981*

[SEAL]

*Attest:*

GERALD J. MOSSINGHOFF

*Attesting Officer*

*Commissioner of Patents and Trademarks*